US007862028B2

(12) United States Patent
Nagata et al.

(10) Patent No.: US 7,862,028 B2
(45) Date of Patent: Jan. 4, 2011

(54) SHEET PROCESSING APPARATUS AND IMAGE FORMING APPARATUS PROVIDED WITH THE SAME

(75) Inventors: Jinichi Nagata, Osaka (JP); Yoshitaka Matsumoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 349 days.

(21) Appl. No.: 12/136,112

(22) Filed: Jun. 10, 2008

(65) Prior Publication Data

US 2008/0309007 A1 Dec. 18, 2008

(30) Foreign Application Priority Data

Jun. 14, 2007 (JP) ..... 2007-157626

(51) Int. Cl.
*B65H 37/04* (2006.01)

(52) U.S. Cl. ..... 270/59; 270/32; 270/45; 270/58.07; 270/58.11

(58) Field of Classification Search ..... 270/4, 270/20.1, 32, 37, 39.01, 45, 59, 58.07, 58.11, 270/58.18; 271/202, 215, 258.01
See application file for complete search history.

(56) References Cited

U.S. PATENT DOCUMENTS

| | | | | |
|---|---|---|---|---|
| 4,938,467 | A | 7/1990 | Honjo et al. | |
| 5,192,261 | A * | 3/1993 | Honjo et al. | 493/29 |
| 5,350,169 | A * | 9/1994 | Hiroi et al. | 271/213 |
| 6,408,147 | B1 * | 6/2002 | Oshida | 399/82 |
| 2006/0180999 | A1 | 8/2006 | Suzuki et al. | |
| 2007/0235917 | A1 * | 10/2007 | Nagasako et al. | 270/58.08 |

FOREIGN PATENT DOCUMENTS

| | | |
|---|---|---|
| JP | 63-247265 | 10/1988 |
| JP | 09-309666 | 12/1997 |
| JP | 2001-072304 | 3/2001 |
| JP | 2005-266245 | 9/2005 |
| JP | 2006-082916 | 3/2006 |
| JP | 2006-143466 | 6/2006 |

* cited by examiner

*Primary Examiner*—Leslie A Nicholson, III
(74) *Attorney, Agent, or Firm*—Renner, Otto, Boisselle & Sklar, LLP

(57) ABSTRACT

A sheet processing apparatus, comprising: a sheet introduction port for feeding a sheet to inside from outside of the sheet processing apparatus; a sheet exit port for ejecting the sheet from inside to outside of the sheet processing apparatus; a sheet carrying part having a sheet carrying passage that communicates the sheet introduction port and the sheet exit port; a fold processing part disposed in a middle of the sheet carrying passage, for arbitrarily folding the sheet; a sheet stacking part that stacks the sheet ejected from the sheet exit port; and a detector that detects whether a height of a bundle of sheets stacked on the sheet stacking part reaches a prescribed height and outputs an OFF signal for turning off a drive of the sheet carrying part, wherein the detector performs detection at a first detection level for detecting the prescribed height of the bundle of sheets folded when the fold processing part is set in a drive state, and at a second detection level for detecting the prescribed height of the bundle of sheets not folded when the fold processing part is in a stop state, with the first detection level and second detection level differentiated from each other.

9 Claims, 4 Drawing Sheets

SHEET PROCESSING APPARATUS AND IMAGE FORMING APPARATUS PROVIDED WITH THE SAME

CROSS-REFERENCE TO RELATED APPLICATION

This application is related to Japanese patent application No. 2007-157626 filed on Jun. 14, 2007 whose priority is claimed under 35 USC §119, the disclosure of which is incorporated by reference in its entirety.

BACKGROUND OF THE INVENTION

1. Field of the Invention

The present invention relates to a sheet processing apparatus and an image forming apparatus provided with the same, and further specifically, relates to the sheet processing apparatus having a fold processing function and the image forming apparatus provided with the same.

2. Description of the Related Art

As an image forming apparatus such as a copying machine, a facsimile machine, and a printer, a publicly-known image forming apparatus has an apparatus body that forms an image on a sheet; a sheet stacking part that stacks the sheet ejected from inside to outside of the apparatus body, with the image formed thereon; and a detector that detects a near full state when the sheet is stacked in this sheet stacking part up to a state of almost a stacking limit amount (so-called a near full state) and stops an ejection of the sheet from the apparatus body. This detector is designed to detect the near full state in which a height of an uppermost surface of a bundle of sheets stacked in the sheet stacking part near the center (a thickness of the bundle of the sheets in a sheet plane near the center) reaches the height in the near full state.

When a sheet ejection is stopped, by taking out the bundle of sheets from the sheet stacking part by a user, the detector detects a state in which the height of the bundle of sheets on the sheet stacking part is reduced, and thereby, the sheet ejection is restarted.

In such an image forming apparatus, when a force from a carrying roller is added to the sheet passing through a bending part of a sheet carrying passage in the apparatus body, the sheet is curled in some cases. When the sheet having a curl is sequentially stacked in the sheet stacking part, usually a warp of a rear edge occurs rather than a central part of the sheet, thus increasing the height of the rear edge, thereby involving a problem that before detecting the near full state by the detector, the rear edge of the uppermost sheet comes above a sheet exit port of the apparatus body, thus allowing the sheet ejected next to collide with the rear edge of the bundle of sheets.

Therefore, instead of the aforementioned detector, the image forming apparatus having a curl detector that detects the rear edge of the sheet that warps due to curl, and stops the ejection of the sheet before the rear edge of the sheet comes above the sheet exit port, is proposed (for example, see Japanese Unexamined Patent Publication Nos. 9-309666 and 2006-82916).

In addition, the copying machine of recent years includes the one having a sheet processing apparatus that performs processing (so-called Z-shaped fold processing) for folding a sheet of A3 size into A4 size, on which an image is formed (for example, see Japanese Unexamined Patent Publication No. 2005-266245). This sheet processing apparatus is coupled to the apparatus body that forms the image on the sheet, and the sheet stacking part is disposed on a wall surface on the opposite side of the apparatus body, for arbitrarily performing the Z-shaped fold processing of the sheet fed from the apparatus body, with the image formed thereon, and ejecting this sheet.

In such a copying machine, image formation is started by selecting a "Z-shaped fold mode" in an operation part, and a Z-shaped folded sheet, with an image formed thereon, is ejected from a fold side and is sequentially stacked in the sheet stacking part. At this time, the Z-shaped folded sheet has a somewhat higher height on the fold side due to increase of thickness of a folded portion and a swelling of the fold. Note that when the Z-shaped folded sheet is stacked, the swelling of a lower sheet is slightly reduced by being compressed by a weight of upper sheets.

When the detector or the curl detector is applied to the sheet processing apparatus having the aforementioned Z-shaped folding function, as described above, the Z-shaped folded sheet has a higher height on the fold side. Therefore, the near full state is detected and the sheet ejection is stopped, even in a stage of smaller number of ejected sheets compared to a normal sheet, and even when there is almost no curl in the sheet. At this time, the height of the bundle of the Z-shaped folded sheets is gradually lowered due to reduction in swelling by its own weight of the sheets as described above, and therefore sheet ejection is stopped even when the sheet stacking part actually still has a room up to the sheet stacking limit amount. Here, the sheet stacking limit amount of the sheet stacking part means a sheet amount capable of preventing at least the sheet ejected from the sheet exit port, from colliding with the rear edge of the bundle of sheets.

In recent years, higher speed of image forming processing and post processing is increasingly desired, and therefore it is desirable to stack the Z-shaped folded sheets in the sheet stacking part as much as possible. However, it is undesirable to stop the sheet ejection in a state of such a small number of stacked sheets, because the number of times of suspending the processing is increased.

SUMMARY OF THE INVENTION

In view of the above-described problem, the present invention is provided, and an object of the present invention is to provide the sheet processing apparatus capable of increasing the stacking limit amount of the sheet that has undergone the fold processing in the sheet stacking part, and the image forming apparatus provided with the same.

Therefore, the present invention provides a sheet processing apparatus, comprising: a sheet introduction port for feeding a sheet to inside of from outside the sheet processing apparatus; a sheet exit port for ejecting the sheet from inside to outside of the sheet processing apparatus; a sheet carrying part having a sheet carrying passage that communicates the sheet introduction port and the sheet exit port; a fold processing part disposed in a middle of the sheet carrying passage, for arbitrarily folding the sheet; a sheet stacking part that stacks the sheet ejected from the sheet exit port; and a detector that detects whether a height of a bundle of sheets stacked on the sheet stacking part reaches a prescribed height and outputs an OFF signal for turning off a drive of the sheet carrying part, wherein the detector performs detection at a first detection level for detecting the prescribed height of the bundle of sheets folded when the fold processing part is set in a drive state, and at a second detection level for detecting the prescribed height of the bundle of sheets not folded when the fold processing part is in a stop state, with the first detection level and second detection level differentiated from each other.

Also, another aspect of the present invention provides an image forming apparatus, including: an apparatus body having an image forming part that forms an image on a sheet, a sheet feeding part that feeds the sheet to the image forming part, and a sheet ejection part that ejects to outside the sheet on which the image formed; and the sheet processing apparatus so as to be coupled to the apparatus body to receive the sheet ejected from the sheet ejection part.

According to the sheet processing apparatus of the present invention, the detection level of the detector that detects the near full state of the sheet stacked in the sheet stacking part is different between a case that the fold processing (such as Z-shaped fold processing) is applied to the sheet and a case that such a fold processing is not applied to the sheet. Therefore, it is possible to increase the stacking limit amount on the sheet stacking part of the sheet subjected to fold processing, compared to the stacking limit amount of the normal sheet not subjected to fold processing. That is, when the fold processing is performed, it becomes possible to continue the processing operation until the height of the bundle of sheets that has undergone the fold processing is larger than the height of the bundle of sheets of the normal sheet, thus making it possible to respond to high speed processing.

In addition, according to the image forming apparatus of the present invention, it becomes possible to speed-up the fold processing of the sheet, with the image formed thereon, and therefore the image forming apparatus of the present invention is effective for the image forming processing and fold processing of a large amount of sheets, such as 50 or more sheets.

DETAILED DESCRIPTION OF THE PREFERRED EMBODIMENTS

Figure 1:
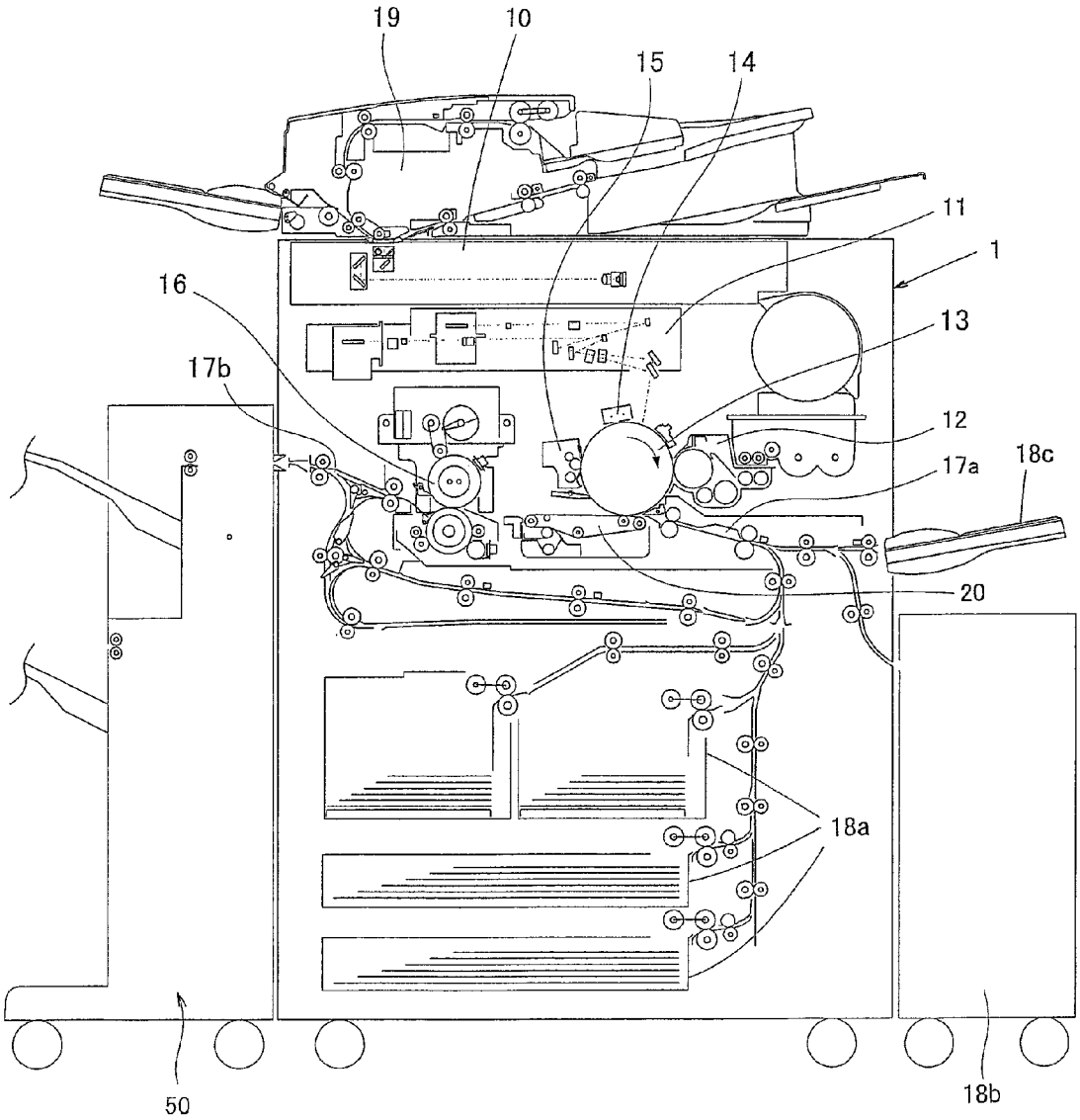
FIG. 1 is a front view showing a schematic structure of an image forming apparatus according to an embodiment 1 of the present invention.

A sheet processing apparatus of the present invention, comprising: a sheet introduction port for feeding a sheet to inside from outside of the sheet processing apparatus; a sheet exit port for ejecting the sheet from inside to outside of the sheet processing apparatus; a sheet carrying part having a sheet carrying passage that communicates the sheet introduction port and the sheet exit port; a fold processing part disposed in a middle of the sheet carrying passage, for arbitrarily folding the sheet; a sheet stacking part that stacks the sheet ejected from the sheet exit port; and a detector that detects whether a height of a bundle of sheets stacked on the sheet stacking part reaches a prescribed height and outputs an OFF signal for turning off a drive of the sheet carrying part, wherein the detector performs detection at a first detection level for detecting the prescribed height of the bundle of sheets folded when the fold processing part is set in a drive state, and at a second detection level for detecting the prescribed height of the bundle of sheets not folded when the fold processing part is in a stop state, with the first detection level and second detection level differentiated from each other.

In the sheet processing apparatus of the present invention, the fold processing part has a function of folding the sheet in a prescribed size and shape, and for example, a conventionally known Z-shaped folding mechanism can be adopted, whereby a sheet of A3 size is folded into the sheet of A4 size, with two folds formed in the sheet of A3 size.

Also, the sheet carrying part includes a linear carrying passage that linearly communicates the sheet introduction port and the sheet exit port for carrying a non-folded flat normal sheet; a branch carrying passage that branches from the side of the sheet introduction port of the linear carrying passage and joins the side of the sheet exit port of the linear carrying passage via the sheet processing part; the carrying roller arranged on these carrying passages at a prescribed interval; and a switching claw that switches a carrying route of the sheet to either one of the linear carrying passage or the branch carrying passage.

In addition, the sheet stacking part can be constituted by a tray attached to a position, for example, downward by about 30 to 40 cm from the sheet exit port, being a wall surface on the side of the sheet exit port of the sheet processing apparatus in an inclined shape, with a tip end side directed upward. In this case, an inclination angle of the stacking surface of the sheet stacking part with respect to a horizontal line is preferably set at about 30 to 60°.

In the explanation given hereunder, regarding the fold processing, a case of the Z-shaped folding will be given as an example. However, the present invention is not limited to the fold processing part having the Z-shaped folding function, and for example, the fold processing part having a double-folding function is applicable.

In the sheet processing apparatus of the present invention, the first detection level and the second detection level are preferably set, so that the height of the bundle of sheets detected at the first detection level is higher than the height of the bundle of sheets detected at the second detection level.

Thus, when the Z-shaped folded sheet is ejected to the sheet stacking part, the detector detects the height of the bundle of sheets (height up to an uppermost surface of the bundle of sheets from the sheet stacking part) at the first detection level, and therefore the Z-shaped folded sheet can be stacked on the sheet stacking part up to a height higher than the stacking limit amount of the bundle of sheets of the normal sheet. That is, when the height of the Z-shaped folded bundle of sheets is detected at the second detection level, the near full state is detected at a time point when the number of stacking sheets is significantly smaller than that of the normal sheets, so that the ejection of the sheet is stopped. However, by switching the level to the first detection level, the stacking limit number of the Z-shaped folded sheets can be increased.

In this case, in consideration of the upward warp of at least the rear edge of the Z-shaped folded sheet due to curl, the first detection level needs to be set so that the detector detects the near full state while the height of the rear edge of the Z-shaped folded bundle of sheets is set to be lower than the sheet exit port.

Although there is no particular restriction in the detector, for example, it can be so constituted to include a contact member having a base end swingably attached to the vicinity of the sheet exit port and a tip end being in contact with the uppermost surface of the bundle of sheets; and a switch part for outputting the OFF signal to turn off the drive of the sheet carrying part, when the position of the base end of the contact member that swings according to a change in the height of the bundle of sheets, reaches the first detection level or the second detection level.

Such a structure of the detector is obtained, with no large change of a design of the structure of the existent detector, and can be obtained only by changing the switch part, thus not involving a significant increase of cost. That is, a first switch for the first detection level set when the Z-shaped fold processing is performed, and a second switch for the second detection level set when the Z-shaped fold processing is not performed are provided, and it can be so constituted that when the Z-shaped fold processing is performed, detection by the first switch is selected, and when the Z-shaped fold processing is not performed, the detection by the second switch is selected.

Meanwhile, as the contact member, for example, a light bar material made of plastic is used, and its base end is pivoted on, for example, an upper part of the sheet exit port of a casing of the sheet processing apparatus by an axis so as to be swung, and the tip end can be disposed to protrude toward the sheet stacking part in an inclination shape, so that the position of the base end may be detected by the first or second switches. In this case, when the ejected sheet is abutted on the contact member, oscillation of the base end occurs in some cases, and therefore the ejection of the sheet may be stopped, when a detection state by each switch continues for a constant period of time or more.

There is no particular restriction in the first and second switches, if they can detect the position of the base end of the contact member, and for example, a proximity sensor such as a magnetic sensitive switch and a photo-coupler can be used. When the magnetic sensitive switch is used, a magnet segment may be fixed integrally with the base end of the contact member. Also, when the photo-coupler is used, the base end of the contact member may be moved between a light projecting element and a light receiving element.

In this sheet processing apparatus, it is preferable that a first ejection speed for ejecting a sheet from the sheet exit port at the time of driving the fold processing part is set to be slower than a second ejection speed for ejecting the sheet from the sheet exit port at the time of stopping the fold processing part. This ejection speed means the time from the time point when one sheet is ejected from the sheet exit port until the time point when the next sheet is ejected. Specifically, 0.5 to 0.75 times the second ejection speed is appropriate as the first ejection speed.

Thus, in the Z-shaped fold processing, before the Z-shaped folded sheet ejected from the sheet exit port first is overlapped on the sheet stacking part or the bundle of the sheets and is stabilized thereon, it is possible to prevent the Z-shaped folded sheet ejected next, from being abutted on the first Z-shaped folded sheet, and each Z-shaped folded sheet can be stacked in a sequentially arranged state without disturbance. Therefore, stacking property can be improved. In addition, by an improvement in the stacking property, detection of the height of the bundle of the Z-shaped folded sheets can be performed with good accuracy.

In this case, the time required for the Z-shaped fold processing can be used as a difference between the first ejection speed and the second ejection speed, and as described above, by setting the first ejection speed at 0.5 to 0.75 times the second ejection speed, the Z-shaped folded sheet can be sequentially ejected so as not to be too fast and not to be too slow, while securing the stacking property. Note that the first ejection speed may be adjusted by controlling the carrying speed of the sheet carrying part in the sheet processing apparatus.

According to another aspect of the present invention, there is provided the image forming apparatus comprising an apparatus body having an image forming part that forms an image on a sheet, a sheet feeding part that feeds the sheet to the image forming part, and a sheet ejection part that ejects the sheet to outside, with the image formed thereon; and the sheet processing apparatus coupled to the apparatus body and to which the sheet ejected from the sheet ejection part is introduced.

In this case, the apparatus body further includes a controller that controls the fold processing part of the sheet processing apparatus in a drive state or in a stop state, and controls the first ejection speed for ejecting the sheet from the sheet exit port when the fold processing part is set in the drive state, and the second ejection speed for ejecting the sheet from the sheet exit port when the fold processing part is set in the stop state.

Further, the controller may control the ejection speed, so that the first sheet ejection speed by the sheet ejection part when the fold processing part is set in the drive state is slower than the second sheet ejection speed by the sheet ejection part when the fold processing part is set in the stop state.

Further, the controller may stop the drive of the sheet feeding part, the image forming part, and the sheet ejection part by inputting the OFF signal from the detector.

An operation control of the sheet processing apparatus and the apparatus body by the detector and the controller as described above can be automatically executed by selecting a "Z-shaped folding mode" by an operation part disposed in the apparatus body.

Preferred embodiments of the present invention will be specifically explained hereunder, with reference to the drawings.

Embodiment 1

FIG. 1 is a front view showing a schematic structure of an image forming apparatus according to an embodiment 1 of the present invention.

This image forming apparatus includes an apparatus body 1 that forms an image on a sheet, and a sheet processing apparatus 50 that applies post-processing to the sheet, with the image formed thereon.

Hereunder, the "sheet" is called "a recording sheet" and "an image formation" is called "printing" in some cases.

The apparatus body 1 forms a monochromatic image on a prescribed recording sheet, according to image data transmitted from outside, and includes an image forming part disposed in an upper part of the apparatus body 1; a sheet feeding part having a sheet feeding cassette 18*a* disposed in a lower part of the apparatus body 1, a large capacity sheet feeding cassette 18*b* connected to a side wall of the apparatus body 1 on an upper stream side in a sheet carrying direction, a manual sheet feeder 18*c* disposed on a side wall of the apparatus body 1 on the upper stream side in the sheet carrying direction, and a sheet carrying passage 17*a* for carrying the sheet from them to the image forming part; a sheet ejection part that sends the recording sheet that has undergone print processing to the sheet processing apparatus 50 via a ejected sheet carrying passage 17*b*; an operation part not shown that operates a setting of the number of copies, selection of a Z-shaped folding mode, selection of a staple mode, and copy start, etc,; and a controller not shown that performs a drive control of the sheet feeding part, the image forming part, and the sheet ejection part on the side of the apparatus body 1, and a drive control of the sheet processing apparatus 50 based on input data by the operation part. The image forming apparatus includes a document feeding part 19 mounted on the apparatus body 1.

In the sheet feeding part, the sheet feeding cassette 18*a* is a tray for feeding the recording sheet used in image formation, and is constituted of a plurality of trays capable of receiving 500 to 1500 sheets of a standard size. In addition, the large capacity sheet feeding cassette (called LCC hereunder) 18*b* is externally mounted to the apparatus body 1, in addition to the sheet feeding cassette 18*a*, so that a high speed printing can be carried out. The LCC 18*b* can perform sheet feeding of, for example, 6000 to 7000 sheets. With this structure, even in a case of the high speed printing, it becomes possible to prevent an occurrence of insufficient sheet feeding, and a function of the high speed printing can be effectively exerted.

The image forming part includes an image reading part 10, an exposure unit 11, a developer 12, a photoconductor 13, a charger 14, a cleaner unit 15, a fuser unit 16, etc.

The image reading part 10 is mainly constituted of a light source holder, a mirror group, and a CCD. When a document sent from a document carrying part 19 is scanned, an image of the document is scanned, in a stationary state of the light source holder and the mirror group.

When the document is carried from the document carrying part 19, the document is irradiated with light from the light source holder, and an optical path of the light reflected from the document is changed via the mirror groups, and the image is formed on the CCD, which is then converted into electronic image data.

The charger 14 is charging means, and is a charging unit of a charger type, for uniformly charging a surface of the photoconductor 13 (photoconductor drum) to a prescribed potential. Note that the charging unit of a contact type (roller type and brush type) other than the charger type can also be used.

The exposure unit 11 is constituted of a laser scanning unit (LSU) having a laser irradiation part and a reflection mirror. In addition, a 2-beam image forming method using a plurality of laser beams is adopted as the exposure unit 11, thus providing a structure capable of performing a high speed print processing by realizing high speed irradiation timing. Note that a writing head having, for example, light emitting elements such as an EL and an LED arranged in an array shape can also be used.

The laser beams corresponding to the image data is generated from the laser irradiation part, and the photoconductor 13 uniformly charged by the charger 14 is irradiated (inputted) with the laser beams. Accordingly, the surface of the photoconductor 13 is exposed by the laser beams corresponding to the inputted image data, and an electrostatic latent image according to the image data is formed on the surface of the photoconductor 13.

The electrostatic latent image formed on the photoconductor 13 is developed by the developer 12 by black toner. In addition, the cleaner unit 15 removes/recovers the toner remained on the surface of the photoconductor 13 after development/image transfer is performed.

The electrostatic latent image developed on the photoconductor 13 is transferred to a recording sheet, by applying an electric field having a reverse polarity in relation to the polarity of an electric charge of the electrostatic latent image, to the recording sheet carried from a transfer mechanism 20 (for example a transfer belt unit). For example, when the electrostatic latent image has the electric charge of negative polarity, an applied polarity of the transfer mechanism 20 is set in a positive polarity.

In the transfer mechanism 20, the transfer belt having a prescribed resistance value (in a range from $1\times10^{9}$ to $1\times10^{23}$ Ω.cm) is arranged in a bridge condition by a driving roller, a driven roller and other roller, and an elastic conductive roller capable of applying a transfer electric field with conductivity different from the driving roller and the driven roller, is arranged in a contact part of the photoconductor 13 and the transfer belt. By disposing the elastic conductive roller in the contact part, the photoconductor 13 and the transfer belt are brought into not a line contact but a plane contact having a prescribed width (called a transfer nip). That is, by making them in the plane contact, a transfer efficiency of the image to the carried recording sheet can be improved.

Note that an electricity eliminating roller for smoothly carrying the carried recording sheet to the next step, in a state of eliminating an electric filed applied in a transfer region, is disposed on a backside of the transfer belt in the downstream side of the transfer region. In addition, the cleaning unit and an electricity eliminating mechanism are disposed in the transfer mechanism 20, for cleaning a stain of the toner of the transfer belt and eliminating electricity of the transfer belt.

The electrostatic image (unfixed toner) transferred to the recording sheet by the transfer mechanism 20 is carried to the fuser unit 16.

The fuser unit 16 includes a heating roller and a pressurizing roller, and a heat source is arranged in an inner peripheral part of the heating roller, for maintaining its surface to a prescribed temperature (fixation set temperature: approximately 160 to 200° C).

In addition, a pressurizing member for setting the pressurizing roller and the heating roller in a press-contact state with a prescribed pressure is disposed on both end portions of the pressurizing roller.

The recording sheet carried to a press-contact part (called a fixing nip portion) of the heating roller and the pressurizing roller is heated and pressurized. Accordingly, the unfixed toner on the recording sheet is melted at a surface temperature of the heating roller, and is fixed to the recording sheet under a tacking action by the press-contact force of the pressurizing roller.

Figure 2:
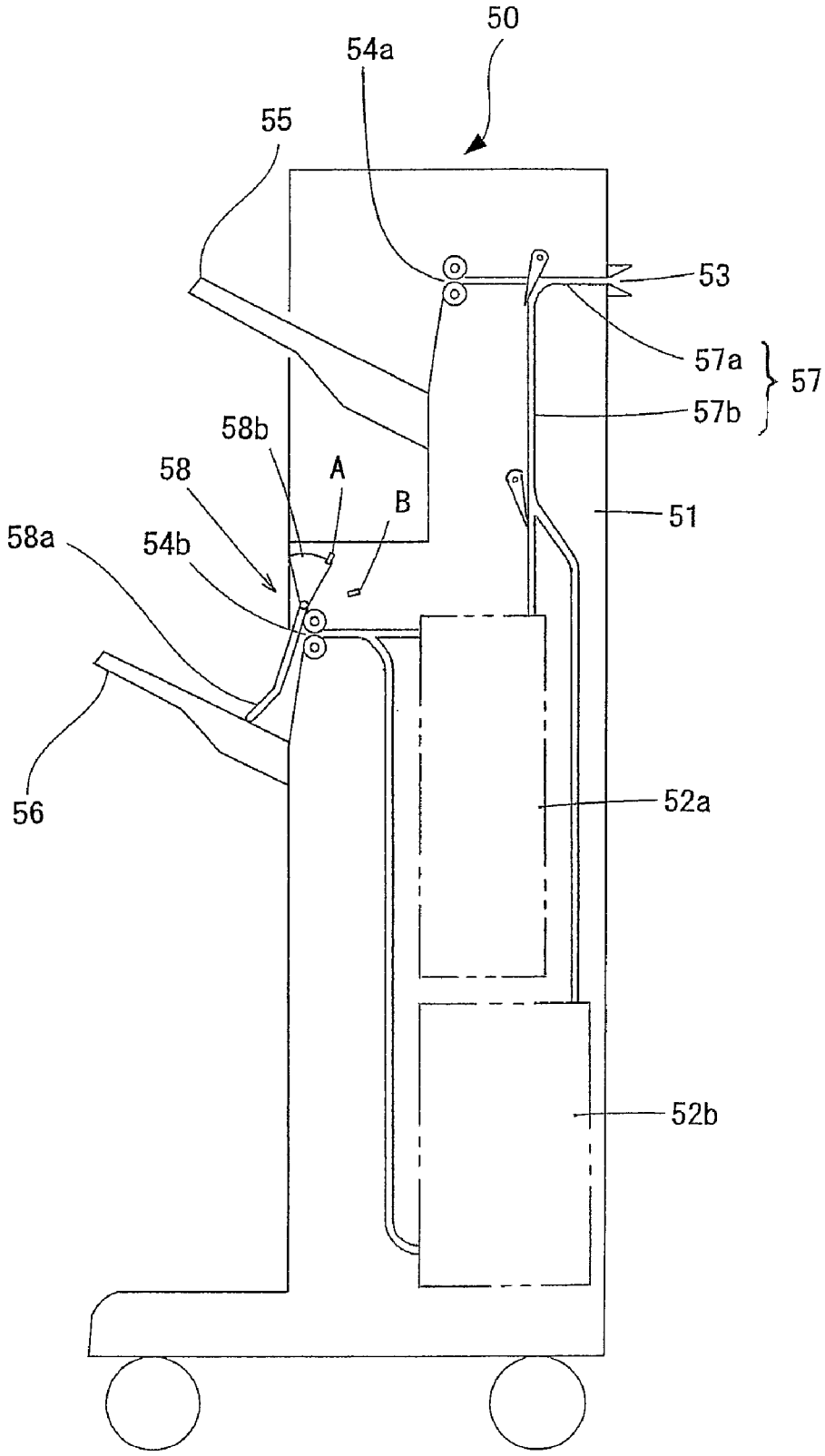
FIG. 2 is a schematic structure showing a sheet processing apparatus of the embodiment 1.

FIG. 2 is a schematic structure showing the sheet processing apparatus 50.

As shown in FIG. 1 and FIG. 2, the sheet processing apparatus 50 includes a body part 51 incorporating a Z-shaped fold processing part 52*a* and a staple processing part 52*b*; a sheet introduction port 53 disposed on a side face on the side of the apparatus body 1 in the body part 51; a first sheet exit port 54*a* and a second sheet exit port 54*b* disposed in upper and lower two stages on the side face on the opposite side of the sheet introduction port 53 in the body part 51; a sheet carrying part having a sheet carrying passage 57 for communicating the sheet introduction port 53 and the first and second sheet exit ports 54*a* and 54*b* and a carrying roller (see FIG. 3) disposed in the sheet carrying passage 57 at a prescribed interval; a first tray 55 and a second tray 56 as a sheet stacking part for stacking the sheets ejected from the first and second sheet exit ports 54*a* and 54*b*; and a detector 58 that detects whether the height of the bundle of sheets stacked on the second tray 56 reaches a detection level, and outputs an OFF signal for turning off the drive of the sheet carrying passage. This sheet processing apparatus 50 is disposed adjacently to the side of the ejected sheet carrying passage 17*b* of the apparatus body 1.

The sheet carrying passage 57 includes a linear carrying passage 57*a* for carrying a non-folded normal sheet; a branch carrying passage 57*b* that branches from the side of the sheet introduction port of this linear carrying passage 57*a* and is connected to a second sheet exit port 54*b* via at least one of the Z-shaped fold processing part 52*a* and the staple processing part 52*b*; a switching claw that switches a sheet carrying route to either one of the linear carrying passage 57*a* and the branch carrying passage 57*b*; and the switching claw that switches the sheet carrying route to either one of the Z-shaped fold processing part 52*a* and the staple processing part 52*b*.

A publicly known Z-shaped folding mechanism is adopted as the Z-shaped fold processing 52*a*, and therefore a detailed structure thereof is not shown. However, when the Z-shaped fold processing is simply explained, first, the tip end of the recording sheet sent to the Z-shaped fold processing part from an upper stream part of the branch carrying passage 57*b* is abutted on a first stopper. The rear edge of the sheet is also carried thereafter, thereby deflecting the sheet, and therefore a deflected portion of the sheet enters between a first folding roller and a second folding roller, to form a first folded part. Thereafter, the sheet passes between the first and second folding rollers and the first folded part is abutted on a second stopper. The rear edge of the sheet is sent thereafter also, and therefore the sheet is deflected and this deflected portion enters between the second folding roller and the third folding roller, to form a second folded part. At this time, the second folded part is folded in a direction opposite to the first folded part. Thereafter, an entire body of the sheet passes between the second and third folding rollers, then passes through a lower stream part of the branch carrying passage 57*b*, which is then sent to the second sheet exit port 54*b*, and is stacked on the second tray 56 in a sate that the second folded part is directed toward the tip end side and the first folded part is directed downward.

Note that the publicly-known staple mechanism is also adopted as the staple processing part 52*b*, and therefore the explanation for the detailed structure and the operation is omitted.

The first tray 55 is fitted to a lifter not shown incorporated in a lower part of the first sheet exit port 54*a* in the body part 51, and is formed in an inclined shape, with the tip end directed upward. When a prescribed amount of sheets are stacked on the first tray 55, this first tray 55 is lowered step by step by the lifter, so that an uppermost surface of the bundle of sheets does not exceed a prescribed height.

The second tray 56 is fitted to a lower position of the second sheet exit port 54*b* in the body part 51, and is formed in an inclined shape, with the tip end directed upward.

Figure 3:
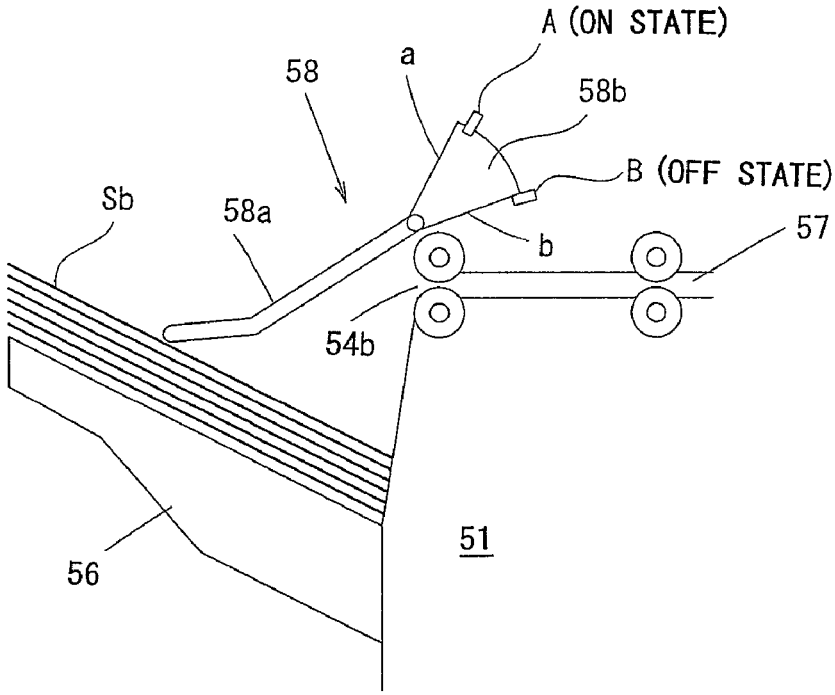
FIG. 3 is a schematic structure showing a detector in the sheet processing apparatus of the embodiment 1.

FIG. 3 is a schematic structure showing the detector 58.

As shown in FIG. 2 and FIG. 3, the detector 58 includes a bar-shaped contact member 58*a*, with the tip end side bent slightly upward; a detected piece 58*b* provided integrally with the base end of the contact member 58*a*; and a first switch A and a second switch B for detecting the detected piece 58*b*.

The contact member 58*a* is formed in an inclined shape, with the base end pivoted on a position above and near the second sheet exit port 54*b* in the body part 51 so as to be swung by an axis, being the position near the longitudinal center of the second sheet exit port 54*b*, and the tip end directed toward the center of the second tray 56 in a free state. Note that FIG. 2 shows an example of a case that the tip end of the contact member 58*a* is abutted on a stacking surface of the second tray 56, when the sheet is not stacked on the second tray 56. However, the tip end of the contact member 58*a* may be set in a floating state to some extent without abutting on the stacking surface. In this case, the base end side of the contact member 58*a* may be regulated, so that oscillation of the contact member 58*a* downward is regulated, for example, by a protruding stopper provided in the body part 51, and the oscillation upward is not regulated.

The detected piece 58*b* is formed, for example, in a fan shape, and a magnet is fixed along its arc shaped outward end.

The first switch A and the second switch B are provided in the vicinity of the detected piece 58*b* on the base end of the contact member 58*a* fitted to the body part 51. The first and second switches A and B are formed of a magnetic sensitive switch which is set in ON state (energizing state), with circuits closed by an action of a magnetic field that occurs by close with the magnet of the detected piece 58*b*, and when the detected piece 58*b* is set apart, the circuit is opened and the first and second switches A and B are set in OFF state (non-energizing state).

Figure 4:
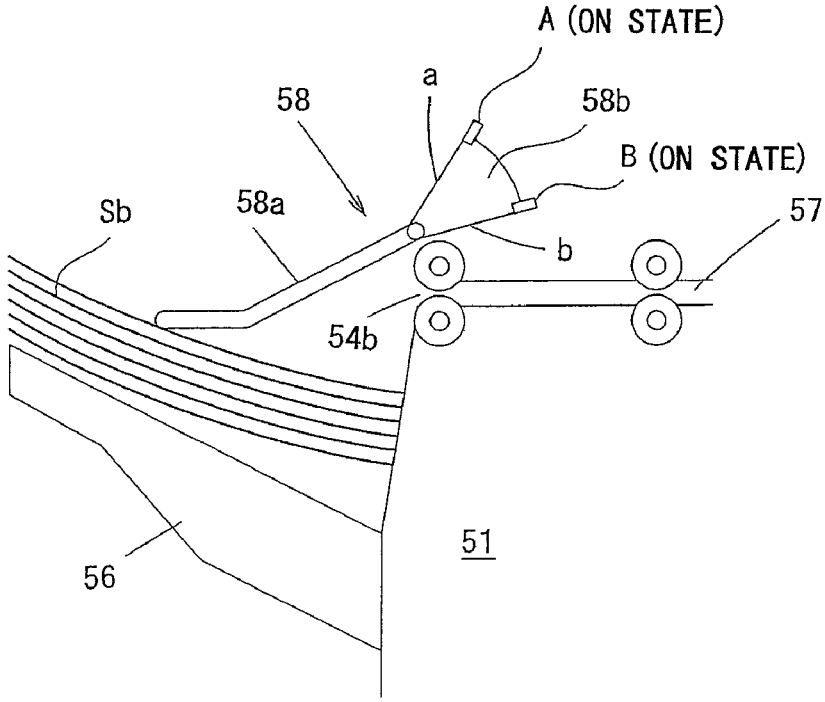
FIG. 4 is an explanatory view showing a condition of detecting a near full state of a bundle of normal sheets having a curl, by the detector in the embodiment 1.

As shown in FIG. 4, the first switch A and the second switch B are disposed at a position overlapped on an outer end of the fan-shaped detected piece 58*b*, at a position that coincides with an angle of a fan of the detected piece 58*b*, that is at a position not protruding from a first edge "a" and a second edge "b" whereby the angle of the fan is formed. At this time, the first switch A is disposed on an upper side, and the second switch B is disposed on a lower side.

The aforementioned first detection level is set by the position of the first switch A, and the second detection level is set by the position of the second switch B, and by changing an interval between the first switch A and the second switch B and the angle of the fan of the detected piece 58*b*, it is possible to change an increase amount of the first detection level with respect to the second detection level.

The first switch A is a switch related to a case that the "Z-shaped folding mode" is selected by the aforementioned operation part of the apparatus body 1. In the Z-shaped folding mode, the printed sheet is subjected to Z-shaped fold processing in the sheet processing apparatus 50, and is sequentially stacked on the second tray 56, the near full state of the bundle of the Z-shaped folded sheets on the second tray 56 is detected by the first switch A.

The second switch B is a switch related to a case that the "staple mode" is selected by the aforementioned operation part of the apparatus body 1. In the staple mode, the printed sheet is subjected to staple processing by the sheet processing apparatus 50, and a plurality of sheets are made into a bundle and are sequentially stacked on the second tray 56, the near full state of the bundle of the staple processed sheets on the second tray 56 is detected by the second switch.

The first and second switches A and B are electrically connected to the controller of the apparatus body 1, and a signal from each switch A and B is outputted to the controller.

Next, an operation of the image forming apparatus of the embodiment 1 and mainly the operation of the sheet processing apparatus 50 will be explained, with reference to FIG. 1 and FIG. 2.

Before using the image forming apparatus, the sheets are not stacked on the first and second trays 55 and 56. At this time, the contact member 58*a* is inclined, with the tip end being abutted on the stacking surface of the second tray 56 in a state closest to a vertical state. In this state, the detected piece 58*b* is completely set apart from the second switch B, and the second edge "b" at a position of the second switch B in a state of FIG. 4 is positioned on the side of the first switch A as shown in FIG. 2. When the detected piece 58*b* is set apart from the second switch B, the second switch B is set in an OFF state. Meanwhile, the first switch A is set in an ON state, because the detected piece 58*b* is positioned at an overlapping place.

When printing is performed to the recording sheet by this image forming apparatus and neither Z-shaped fold processing nor staple processing is performed, the sheet carrying passage of the sheet processing apparatus 50 is switched to the linear carrying passage 57*a*. Accordingly, the printed sheet is sent to the sheet introduction port 53 of the sheet processing apparatus 50 from the ejected sheet carrying passage 17*b* of the apparatus body 1, which is then passed through the linear carrying passage 57*a* and is ejected from the sheet exit port 54*a*, and is stacked on the first tray 55.

When the "staple mode" is selected by the operation part, only the signal from the second switch B is selectively transmitted to the controller, or only the signal from the second switch B is selectively received by the controller. In addition, the sheet carrying route of the sheet processing apparatus 50 is switched to the branch carrying passage 57*b*, and is further switched to a route passing through the staple processing part 52*b*. Accordingly, already printed sheets ejected from the apparatus body 1 are passed through the branch carrying passage 57*b* of the sheet processing apparatus 50 and are sent to the staple processing part 52*b*, where the staple processing is applied to the sheets to put them into a bundle, and the bundle of the sheets Sb is ejected from the sheet exit port 54*a* and is, as shown in FIG. 3, stacked on the second tray 56. At this time, the bundle of sheets Sb pushes aside the contact member 58*a* of the detector 58 and protrudes, then drops and is grounded on the second tray 56, and slides down the second tray 56 by its inclination, so that the rear edge is abutted on a wall face of the body part 51.

When a plurality of bundles of sheets Sb are stacked on the second tray 56, the height of the plurality of bundles of sheets Sb is gradually increased, and accompanying this increase, an inclination angle of the contact member 58*a* that abuts on the uppermost surface of the bundle of sheets Sb of an uppermost level is gradually closer to horizontal, and also the second edge "b" of the detected piece 58*b* is gradually closer to the second switch B. Then, when the detected piece 58*b* moves to a position overlapping on the second switch B, the second switch B is switched from the OFF state to the ON state (see FIG. 4), and the OFF signal is outputted to the controller from the second switch B, for reporting the near full state close to a limit of the height of the sheets that can be stacked on the second tray 56, thereby stopping the drive of the sheet processing apparatus 50 and the apparatus body 1 by the controller, so that ejection of the bundle of sheets Sb from the second sheet exit port 54*b* of the sheet processing apparatus 50 is stopped. Note that the height of the bundle of sheets Sb in the near full state is set at, for example, 15 to 20 mm.

In this case, when the plurality of bundles of sheets Sb are protruded intermittently from the second sheet exit port 54*b*, oscillation of the contact member 58*a* and the detected piece 58*b* occurs, and therefore there is a case that the second switch B outputs the OFF signal, even if still having a room from the near full state. Accordingly, in order to detect an accurate near full state, it is so designed that the controller stops the drive of the sheet processing apparatus 50 and the apparatus body 1, when the OFF signal continues for a constant period of time (such as 20 seconds).

Further, in addition to the aforementioned constant period of time, the drive of the sheet processing apparatus 50 and the apparatus body 1 may be stopped, after all sheets within the sheet processing apparatus 50 or all sheets from the image forming part of the apparatus body 1 on a lower stream side in a sheet carrying direction are ejected to the second tray 56.

Accordingly, it is preferable to set the second detection level in consideration of the aforementioned matter.

Incidentally, when the sheets pass through a bending part of the sheet carrying passage in the image forming apparatus, curl of the sheet sometimes occurs, when the sheet receives a force of the carrying roller in the vicinity of the bending part. As shown in FIG. 4, when the bundle of sheets Sb having curl is stacked on the second tray 56, a gap is formed between the second tray 56 and the bundle of sheets Sb, and between bundles of sheets Sb, thereby making the height higher than a case that a plurality of bundles of flat sheets Sb as shown in FIG. 3 with no curl are stacked. Accordingly, when the plurality of bundles of sheets Sb having curl are stacked on the second tray 56, the near full state is detected by the detector 58 when the number of bundles is smaller than the bundles of flat sheets Sb, thus preventing the next bundle of sheets Sb ejected from the second sheet exit port 54*b*, from being abutted on the upward warps of the rear edge of the bundles of sheets Sb due to curl.

Figure 5:
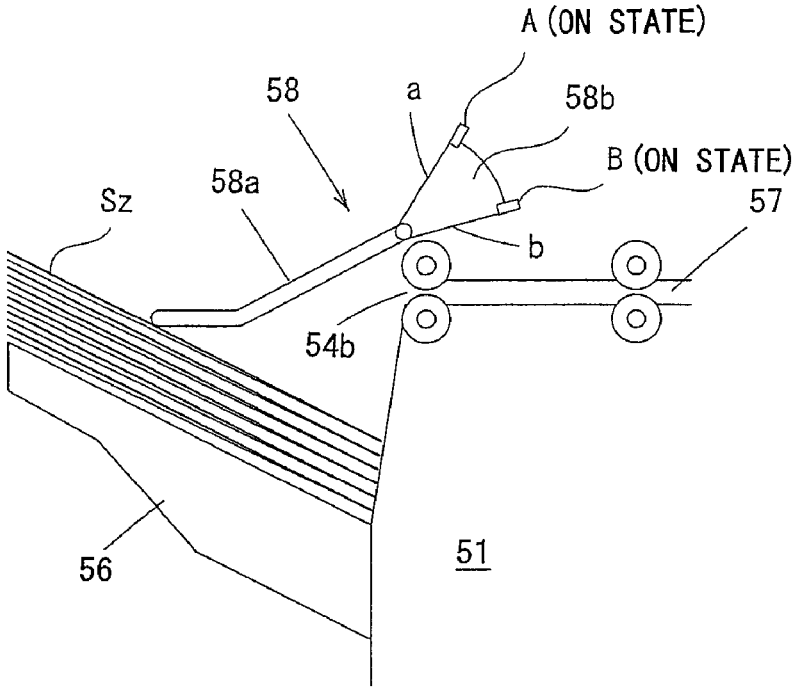
FIG. 5 is an explanatory view showing a condition of sequentially stacking Z-shaped folded sheets on a second tray in the embodiment 1.

When the "Z-shaped folding mode" is selected in the operation part, only the signal from the first switch A is selectively transmitted to the controller, or only the signal from the first switch A is selectively received by a controller. Also, the sheet carrying route of the sheet processing apparatus 50 is switched to the branch carrying passage 57*b* and is further switched to a route passing through the Z-shaped fold processing part 52*a*. Accordingly, the already printed sheet ejected from the apparatus body 1 passes through the branch carrying passage 57*b* of the sheet processing apparatus 50, which is then sent to the Z-shaped fold processing part 52*a*, where the Z-shaped fold processing is applied thereto, and the Z-shaped folded sheet Sz is ejected from the sheet exit port 54*a* and is, as shown in FIG. 5, stacked on the second tray 56.

At this time, the first ejection speed, being the time from the ejection of the first Z-shaped folded sheet Sz from the second sheet exit port 54*b* until the next Z-shaped folded sheet Sz is ejected from the second sheet exit port 54*b*, is slower than the second ejection speed whereby the normal sheet is sequentially ejected from the first sheet exit port 54*a*. This is because the processing time is required for performing the Z-shaped fold processing, and the sheet carrying route becomes further longer. Thus, in the Z-shaped fold processing, before the Z-shaped folded sheet ejected first from the second sheet exit port 54*b* overlaps on the second tray 56 or on the bundle of Z-shaped folded sheet Sz and is stabilized thereon, the Z-shaped folded sheet Sz ejected next can be prevented from abutting on the first Z-shaped folded sheet Sz, thus making it possible to stack each Z-shaped folded sheet in a sequential arranged state without disturbance. That is, stacking property can be improved. In addition, by improvement of the stacking property, the height of the bundle of the Z-shaped folded sheet can be accurately detected.

However, it is preferable to set the first ejection speed not too fast and not too slow, and the first ejection speed is preferably set to be 0.5 to 0.75 times the second ejection speed. When the first ejection speed is set not within the aforementioned range, a rotation speed of the carrying roller of the branch carrying passage 57*b* may be controlled by the controller, so that the first ejection speed is 0.5 to 0.75 times the second ejection speed. Thus, there is no necessity for adjustment of the processing time in relation to a quality of the Z-shaped fold processing.

Figure 6:
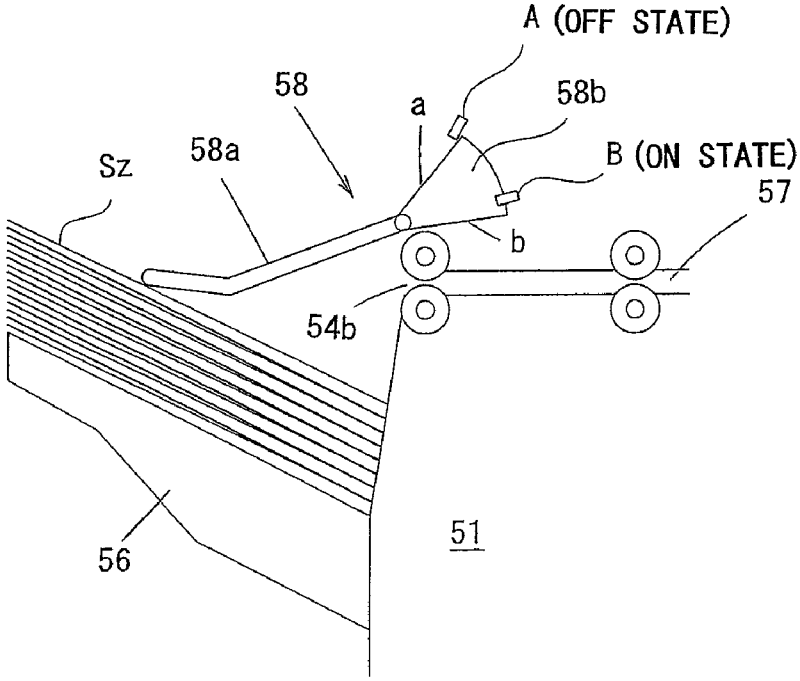
FIG. 6 is an explanatory view showing a condition of detecting the near full state of the bundle of the Z-shaped folded sheets, by the detector in the embodiment 1.

When a plurality of Z-shaped folded sheets Sz are stacked on the second tray 56, the height of the bundle of the Z-shaped folded sheets Sz is gradually increased, and accompanying such an increase, the inclination angle of the contact member 58*a* that abuts on the uppermost surface of the Z-shaped folded sheet Sz of the uppermost level is gradually closer to horizontal, and also the second edge "b" of the detected piece 58*b* is gradually closer to the second switch B. Then, when the detected piece 58*b* moves to the position overlapping on the second switch B, the second switch B is changed to the ON state (state shown in FIG. 5) from the OFF state (state shown in FIG. 2), and the OFF signal is outputted. However, as described above, the controller does not respond to the signal from the second switch B. Accordingly, since the Z-shaped folded sheet Sz is also ejected to the second tray 56 thereafter, the height of the bundle of the Z-shaped folded sheet Sz is further increased, and as shown in FIG. 6, when the first edge "a" of the detected piece 58*b* passes through the first switch A, and the detected piece 58*b* and the first switch A are not overlapped with each other, the first switch A detects the near full state in the Z-shaped folding mode, and outputs the OFF signal to the controller. Whereby, the controller stops the drive of the sheet processing apparatus 50 and the apparatus body 1, so that the ejection of the Z-shaped folded sheet Sz from the second sheet exit port 54*b* of the sheet processing apparatus 50 is stopped. Note that the height of the bundle of the Z-shaped folded sheets Sz in the near full state is set to be, for example, 20 to 25 mm.

Similarly to a case of the staple mode, in a case of the Z-shaped folding mode also, the contact member 58*a* is swung by intermittent protrusion of the plurality of Z-shaped folded sheets Sz, and even when there is still a room from the near full state, the first switch A sometimes outputs the OFF signal. Further, in a case of the Z-shaped folding mode, a swelling by the first and second folding parts in a lower Z-shaped folded sheet Sz stacked first on the second tray 56 is reduced by a weight of an upper Z-shaped folded sheets stacked later. Therefore, in order to detect an accurate near full state, it is so designed that the controller stops the drive of the sheet processing apparatus 50 and the apparatus body 1 when the OFF signal continues for a constant period of time or more (such as 10 seconds).

Further, in addition to the aforementioned constant period of time, the drive of the sheet processing apparatus 50 and the apparatus body 1 may be stopped, after all sheets within the sheet processing apparatus 50 or all sheets from the image forming part of the apparatus body 1 on a lower stream side in a sheet carrying direction are ejected to the second tray 56.

Accordingly, preferably the first detection level is set in consideration of the aforementioned matter.

In addition, although not shown, in a case of the Z-shaped folded mode also, when the sheet passes through the bending part of the sheet carrying passage in the image forming apparatus, curl of the Z-shaped folded sheet occurs in some cases. When the bundle of the Z-shaped folded sheets Sz having the curl is stacked on the second tray 56, the near full state is detected by the detector 58 when the number of sheets is smaller than the bundle of the flat Z-shaped folded sheets Sz, and the next Z-shaped folded sheet Sz ejected from the second sheet exit port 54*b* is not abutted on a warping portion of the rear edge of the Z-shaped folded sheet Sz due to curl.

Embodiment 2

The aforementioned embodiment 1 shows a case that the sheet processing apparatus ejects the normal sheet and the Z-shaped folded sheet from different sheet exit ports. However, these sheets may be ejected from the same sheet exit port.

In this case, when FIG. 2 is referenced and explained, the second ejection port 54*b* and the second tray 5 are omitted, then the branch carrying passage 57*b* on the lower stream side of the Z-shaped fold processing part 52*a* in the sheet carrying direction is connected to the linear carrying passage 57*a*, and the detector 58 is disposed in the vicinity of the first sheet exit port 54*a*. Note that the lifter that lifts the first tray 55 and the staple processing part 52*b* may be provided or not provided.

When the lifter that lifts the first tray 55 is provided, the first tray 55 is lowered step by step by the lifter when the normal sheet or the Z-shaped folded sheet is sequentially stacked on the first tray 55. Therefore, near full detection by the detector 58 is not required. However, after the first tray 55 moves to a lowermost position, similarly to the embodiment 1, the detector 58 detects a state that the bundle of the normal sheets or the Z-shaped folded sheets stacked on the first tray 55 are set in the near full state, so that the sheet ejection is stopped. Note that the near full detection by the detector 58 when the lifter is not provided, is the same as that of the embodiment 1 from the first sheet ejection.

Other Embodiment

The embodiments 1 and 2 show a case of detecting the near full state of the bundle of the Z-shaped folded sheets Sz by the first switch A in a case of the Z-shaped folding mode. However, when printing is performed to a special sheet having thickness thicker than the normal sheet (without Z-shaped fold processing), by selecting the "special sheet mode" in the operation part, the near full state of the bundle of the special sheets can be detected by the first switch A. In this case, more special sheets can be stacked on the sheet stacking part of the sheet processing apparatus, than the sheets in a case of detecting the near full state of the bundle of the special sheets by the second switch B.

What is claimed is:

1. A sheet processing apparatus, comprising:

a sheet introduction port for feeding a sheet to inside from outside of the sheet processing apparatus;

a sheet exit port for ejecting the sheet from inside to outside of the sheet processing apparatus;

a sheet carrying part having a sheet carrying passage that communicates the sheet introduction port and the sheet exit port;

a fold processing part disposed in a middle of the sheet carrying passage, for arbitrarily folding the sheet;

a sheet stacking part that stacks the sheet ejected from the sheet exit port; and a detector that detects whether a height of a bundle of sheets stacked on the sheet stacking part reaches a prescribed height and outputs an OFF signal for turning off a drive of the sheet carrying part, wherein the detector performs detection at a first detection level for detecting the prescribed height of the bundle of sheets folded when the fold processing part is set in a drive state, and at a second detection level for detecting the prescribed height of the bundle of sheets not folded when the fold processing part is in a stop state, with the first detection level and second detection level differentiated from each other.

2. The sheet processing apparatus according to claim 1, wherein the first detection level and the second detection level are set, so that a height of the bundle of sheets detected at the first detection level is higher than the height of the bundle of sheets detected at the second detection level.

3. The sheet processing apparatus according to claim 1, wherein the detector includes a contact member having a base end swingably attached to the vicinity of the sheet exit port and a tip end being in contact with an uppermost surface of the bundle of sheets; and a switch part that outputs the OFF signal for turning off a drive of the sheet carrying part when a position of the base end of the contact member that swings according to a change in a height of the bundle of sheets reaches the first detection level or second detection level.

4. The sheet processing apparatus according to claim 1, wherein a first ejection speed for ejecting the sheet from the sheet exit port at the time of driving the fold processing part is slower than a second ejection speed for ejecting the sheet from the sheet exit port at the time of stopping the fold processing part.

5. The sheet processing apparatus according to claim 4, wherein the first ejection speed is 0.5 to 0.75 times the second ejection speed.

6. An image forming apparatus, comprising:

an apparatus body having an image forming part that forms an image on a sheet, a sheet feeding part that feeds the sheet to the image forming part and a sheet ejection part that ejects to outside the sheet on which the image formed, and the sheet processing apparatus according to claim 1 so as to be coupled to the apparatus body to receive the sheet ejected from the sheet ejection part.

7. The image forming apparatus according to claim 6, wherein the apparatus body further comprises a controller that controls the fold processing part of the sheet processing apparatus in a drive state or in a stop state, and controls a first ejection speed for ejecting the sheet from the sheet exit port in the driving state of the fold processing part, and a second ejection speed for ejecting the sheet from the sheet exit port in the stop state of the fold processing part.

8. The image forming apparatus according to claim 7, wherein the controller performs control, so that the first sheet ejection speed by the sheet ejection part in a driving state of the fold processing part, is slower than the second sheet ejection speed by the sheet ejection part in a stop state of the fold processing part.

9. The image forming apparatus according to claim 7, wherein the controller stops a drive of the sheet feeding part, the image forming part, and the sheet ejection part, when the OFF signal is inputted from the detector.

* * * * *